United States Patent [19]

Sano et al.

[11] Patent Number: 4,833,758

[45] Date of Patent: May 30, 1989

[54] APPARATUS FOR PREPARING A NONWOVEN WEB

[75] Inventors: Takao Sano; Masafumi Ogasawara; Seishiro Ichikawa, all of Ohtsu, Japan

[73] Assignee: Toray Industries, Inc., Tokyo, Japan

[21] Appl. No.: 186,790

[22] Filed: Apr. 25, 1988

Related U.S. Application Data

[63] Continuation of Ser. No. 379,299, Mar. 18, 1982, abandoned.

[51] Int. Cl.[4] ..... D01G 25/00; D02G 1/16

[52] U.S. Cl. ..... 19/304; 28/254

[58] Field of Search ..... 28/254, 271; 19/304

[56] References Cited

U.S. PATENT DOCUMENTS

| | | | |
|---|---|---|---|
| 3,408,697 | 11/1968 | Graig | 19/304 |
| 3,822,543 | 7/1974 | Edagawa et al. | 28/254 X |
| 3,859,697 | 1/1975 | Guenther | 28/254 |
| 3,923,587 | 12/1975 | Porte | 28/254 X |
| 4,172,307 | 10/1979 | Wagner et al. | 19/299 |
| 4,217,387 | 8/1980 | Viezee et al. | 428/288 |
| 4,380,104 | 4/1983 | Kamioka et al. | 28/254 X |

FOREIGN PATENT DOCUMENTS

| | | | |
|---|---|---|---|
| 0010756 | 5/1980 | European Pat. Off. . | |
| 0033855 | 9/1981 | European Pat. Off. . | |
| 4522907 | 7/1970 | Japan | 28/254 |
| 0494026 | 1/1974 | Japan . | |
| 0521183 | 6/1977 | Japan . | |

*Primary Examiner*—Werner H. Schroeder
*Attorney, Agent, or Firm*—Frank P. Presta

[57] ABSTRACT

An apparatus for preparing a nonwoven web in which a bundle of continuous filaments is jetted from a nozzle together with a fluid stream, the filaments and the fluid stream impinge upon a first impinging surface, and after impinging, the filaments and at least a part of the fluid stream are guided to a collecting surface by a second impinging surface.

4 Claims, 5 Drawing Sheets

APPARATUS FOR PREPARING A NONWOVEN WEB

This application is a division of application Ser. No. 377,299, filed on May 18, 1982, now abandoned.

DESCRIPTION

1. TECHNICAL FIELD

This invention relates to the preparation of nonwoven webs from continuous filaments and more specifically to an apparatus used to move the filaments jetted together with a fluid from a nozzle to a collecting surface.

2. BACKGROUND ART

Japanese Patent Publication No. 4026/1974 discloses the technique which, in jetting a filament bundle from a nozzle together with a high velocity. fluid, causes them to impinge against an impinging plate having a plane inclining with respect to the axis of the nozzle and disposed away from the end surface of the nozzle with a gap between them, a fluid different from the fluid to be jetted from the nozzle is introduced so as to disintegrate and disperse the filaments and the impinging plate is permitted to swing so as to expand the filament bundle.

Japanese Patent Laid-Open No. 1183/1977 makes use of the convex surface at the portion, where the high velocity fluid impinges, in place of the flat surface of the impinging plate of the above-mentioned Patent Publication No. 4026/1974 in order to solve the drawback of the prior art.

In either of the prior art, the filaments discharged from the impinging plate are collected on the collecting surface of a collecting machine, but the filaments moving to the collecting surface are not satisfactorily controlled by the fluid scattering from the impinging plate, so that nonuniformity is likely to occur in the thickness and weight per unit area of the resulting web. For instance, the position of the filaments to be collected on the collecting surface are likely to move back and forth in accordance with the charge in the velocity of the high velocity fluid.

The present invention is therefore directed provide an apparatus for forming a nonwoven web which is substantially devoid of non-uniformity in both thickness and weight per unit area and has high quality, by positively guiding the filament bundle jetted together with the fluid towards the collecting surface, thereby eliminating the problems appeared in the prior art.

DISCLOSURE OF THE INVENTION

An apparatus of the invention comprises (a) a nozzle to jet continuous filaments together with a fluid, (b) a first impinging surface to impinge the continuous filaments and the fluid jetted from the nozzle, (c) a collecting surface to collect the filaments in dispersed state and to form a nonwoven web, and further (d) a second impinging surface interposed in a stream of the filaments moving from the first impinging surface to the collecting surface to positively guide the stream of the filaments and at least a part of the fluid towards the collecting surface.

DETAILED DESCRIPTION OF THE PREFERRED EMBODIMENTS

Figure 1:
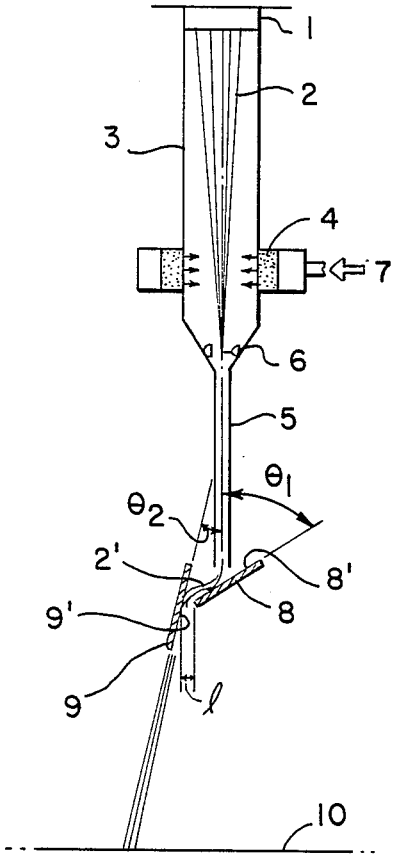
FIG. 1 is a sectional view diagrammatically showing an example of the apparatus used for carrying out the invention.

FIG. 1 is a sectional view diagramatically illustrating an example of the apparatus used for carrying out the present invention. In FIG. 1, reference numeral 1 represents a spinnineret having a large number of spinning orifices, and a filament bundle 2 is formed by simultaneously discharging a molten polymer from the spinning orifices of the spinneret 1. Reference numeral 3 represents a spinning cylinder which covers the lower part of the spinneret and is disposed so as to cool and solidify the filaments 2 discharged from the spinneret 1.

The inside of the spinning cylinder 3 and the spinneret 1 are shut off from the atmosphere except at a portion to draw the filaments 2 from the cylinder 3. A compressed fluid 7 is introduced into the. spinning cylinder 3 from a compressed fluid inlet 4 that is disposed at a part of the inner circumferential wall of the spinning cylinder 3 and the compressed fluid is discharged from a nozzle 5 connected to the bottom tip of the spinning cylinder 3, together with the filaments 2. The filaments 2 are oriented by the pulling force of the high velocity fluid between the compressed fluid inlet 4 of the spinning cylinder 3 and the opening of the nozzle 5.

In another embodiment, an ejector is disposed below the spinneret 1 without using the spinning cylinder 3 so that the ejector may be used at the fluid pulling device of the filaments extruded from the spinneret 1 (such is not shown in the drawing).

In FIG. 1, the filament bundle 2' jetted from the opening at the tip of the nozzle 5 together with the high velocity fluid impinges against a first impinging plate 8 disposed in the proximity of the opening at the tip of the nozzle 5 and its jet direction is changed. The first impinging plate 8 is disposed at an angle $\theta_1$ with respect to the axis of the nozzle 5.

A second impinging plate 9 is disposed downstream of the first impinging plate 8 with a gap (l) between them and the impinging surface 9' of the second impinging plate 9 is inclined at an angle $\theta_2$ with respect to the axis of the nozzle 5. The moving direction of the filament bundle 2' and that of a part of the high velocity fluid are again changed by the second impinging plate 9 and they are thus guided towards the collecting surface 10.

As also shown in FIG. 1, it is preferred that the filament bundle 2 is electrostatically charged by a corona discharger 6 or the like disposed upstream of the nozzle 5 before it is jetted from the nozzle 5, because more uniform disintegration and saficient separation of the filaments can be effected and a higher grade nonwoven web can be produced by so doing. An electric charging device is shown in European Patent Publication Nos. 33,855 and 10,756. Preferably, the collecting surface 10 is an endless conveyor belt having air permeability such as a metal net, and suction is preferably effected from the lower surface of the collecting surface via a suction device or the like (not shown) in order to stably accumualte and forming the nonwoven webs on the collecting surface 10.

Figure 2A:
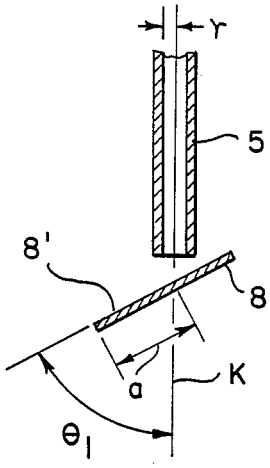
FIG. 2*a* is a transverse sectional view useful for explaining the first impinging plate appeared in FIG. 1
Figure 2B:
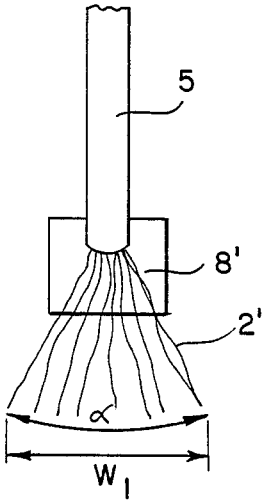
FIG. 2*b* is a front view of the apparatus shown in FIG. 2*a;*
Figure 3:
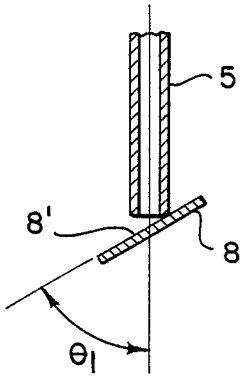
FIGS. 3 and 4 are transverse sectional view useful for explaining other embodiments of the first impinging plate appeared in FIG. 1 respectively.
Figure 4:
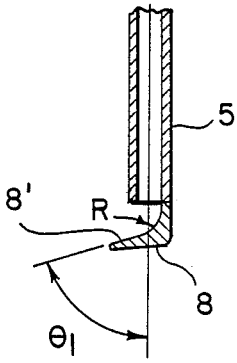

The quality (non-uniformity in per unit area and thickness) of the web layer on the collecting surface 10 depends upon the condition of disintegration and separation of the filaments discharged from ,the first impinging plate 8, as described already, and is affected by the size and shape of the first impinging plate 8. According to the experiments carried out by the inventors of the present invention, the shape of the first impinging plate 8, the travelling length a of the filaments on the impinging surface 8' (see FIG. 2) and the angle of inclination $\theta_1$ of the impinging surface 8' with respect to the nozzle axis (see FIG. 2) are found to be significant factors. FIGS. 2*a* and 2*b* shows the relation between the nozzle 5 and the impinging plate 8, wherein FIG. 2*a* is a sectional view and FIG. 2*b* is a front view. In FIG. 2*b*, the degree of expansion $\alpha$ (alpha) of the filaments (with $W_1$ representing the width of expansion) becomes maximal when th angle of inclination $\theta_1$ of the impinging surface 8' relative to the nozzle axis K placed in vertical direction is from about 70 to about 80 degrees more preferably from about 75 to about 80 degrees. It is preferred in this instance that a group of filaments that are disintegrated and expanded on and along the impinging surface 8' radially expand in the fan-like shape without causing mutual entanglement of the individual filaments forming the group of filaments. In this case, if the travelling length a of the group of filaments on the impinging surface 8' (distance between the position at which the nozzle axis K crosses the impinging surface and the tip of the impinging plate 8) is too long, the disintegrated filaments are likely to entangle with one another. Accordingly, the relation $a/r \leqq 10$ is preferably satisfied where r represents the radius of the nozzle opening. Preferably the distance between the tip of the opening of the nozzle 5 and the impinging plate 8 is short, as shown in FIG. 2*a*. Utilization efficiency of the fluid force becomes higher if they come into contact with each other as shown in FIG. 3, and drop in the moving speed of the filaments after leaving the impinging surface 8' becomes smaller in that case. Furthermore, the optimal shape which is explained more detail hereinafter with FIGS. 17 through 20 is such that the back of the tip of the nozzle opening smoothly continues the impinging surface 8' with curvature R, as illustrated in FIG. 4.

In other words, the first impinging plate 8 in the present invention effectively utilizes the diffused flow due to the impingement of the high velocity fluid jetted from the nozzle 5 for the purpose of disintegration and expansion of the filaments. It is therefore different from the impinging plate of the method, such as one disclosed in Japanese Patent Publication No. 4026/1974, in which a fluid different from the jetted from the nozzle is introduced in order to disintegrate and expand the filaments.

Figure 5A:
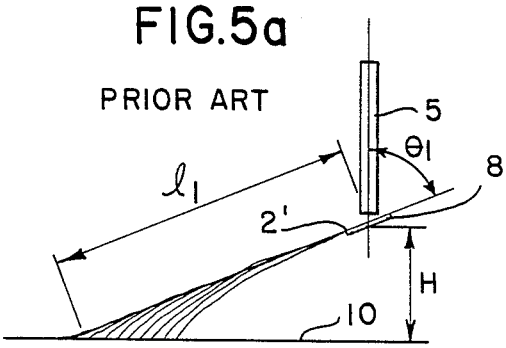
FIG. 5a PRIOR ART
FIG. 5*a* is a schematic side view useful for explaining the state of disintegration and expantion of the filaments in a prior art and FIG. 5*b* is a front view of the apparatus shown in FIG. 5*a;*
Figure 5B:
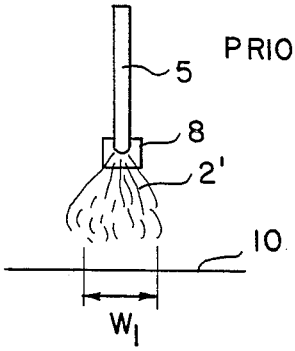
FIG. 5b PRIOR ART

In collecting the filaments coming off from the first impinging plate 8, if the distance from the impinging plate 8 to the collecting surface 10 (H representing the collecting distance which is a vertical distance and $l_1$ representing the distance along the flow of the fiber) is too long such as shown in FIG. 5*a*, the velocity of the high velocity fluid jetted from the nozzle 5 drops and the filament bundle that has conveyed by the fluid can not be controlled in a satisfactory manner. Consequently, expansion $W_1$ of the filaments 2'reaches saturation and satisfactory expansion can not be obtained, as depicted in FIG. 5*b*.

On the other hand, expansion due to the first impinging surface 8' becomes optimal when $\theta_1$ shown in FIG. 1 is from about 70 to about 80 degrees, but at this angle of inclination there occurs the problem that the collecting distance becomes long irrespective of the degree of the collecting distance H. This results in the problem that the fluid can not satisfactorily control the filament bundle conveyed onto the collecting surface.

Figure 6A:
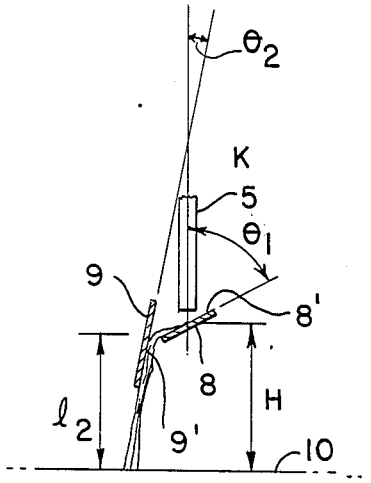
FIG. 6*a* is a schematic view showing the state of disintegration and expansion of the filaments when the second impinging plate is employed in accordance with the invention and FIG. 6*b* is a front view of the apparatus shown in FIG. 6*a;*
Figure 6B:
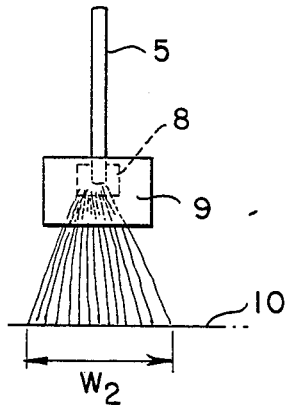

The apparatus in accordance with the present invention contemplates to guide the filaments to the collecting surface 10 while maintaining the shape of the filaments that have been sufficiently expanded. More definitely, as shown in FIGS. 1, 6*a* and 6*b*, the second impinging plate 9 is disposed downstream of the first impinging plate 8 with a gap between them and with an angle $\theta_2$ with respect to the axis K of the nozzle. Preferably, the angle $\theta_2$ is not much large and is up to about 45 degrees. The high velocity fluid and the filament bundle 2'that are discharged from the first impinging surface 8' are expanded in the fanlike shape and impinge against the impinging surface 9' of the second impinging plate 9 while the velocity of the fluid does not much drop. The filament bundle 2′ is guided onto the collecting surface together with the fluid by the second impinging plate 9. The fluid has the collecting action for the filaments until it reaches the collecting surface 10. Needless to say, part of the fluid jetted from the nozzle scatters into the atmosphere during the processes in which it impinges against the first and second impinging plates 8 and 9, but at least a part of the fluid is used for guiding the filament bundle to the collecting surface.

Accordingly, in the present invention, H shown in FIG. 6*a* and the effective collecting distance $l_2$ of the second impinging plate 9 are selected so as to establish the best condition.

This point will be explained in further detail.

The fluid stream after impinging against the first impinging plate 8 leaves the same and is divided into the flow bound for the direction of extention of the impinging surface 8′ and the flow peeling off from the former. The peeling flow is likely to occur in the upward direction with respect to the extension of the impinging surface 8′. Accordingly, the second impinging plate 9 is disposed downstream of the first impinging plate 8 so as to guide the fluid flow onto the extension surface of the second impinging surface 9′.

Since the filament bundle 2′, that has been disintegrated and expanded by the first impinging plate 8, has greater specific gravity than the fluid (compressed air, in this case), it has a velocity component in the direction of the gravitational force (or towards the collecting surface 10, in this case). For this reason, if the first impinging surface 8′ alone is employed, the velocity vector of the fluid does not coincide with the velocity vector of the disintegrated and expanded filament bundle especially in the direction of the gavitational force. Due to the synergistic effect with the peel phenomenon of the fluid, the fluid force can no longer restrict the filament bundle if the effective collecting distance $l_1$ is long so that so-called "stalling" occurs and the filaments entangle with one another. In order to prevent this phenomenon and to guide the filament bundle reliably and stably to the collecting surface, the apparatus of the present invention converts the jetting direction of the fluid towards the collecting surface 10 (in the direction of the gravitational force, in this case) together with the filament bundle by means of the second impinging plate 9 and thus to align the velocity vectors of the materials having mutually different specific gravity. Accordingly, the fluid force restricts the filament bundle up to the collecting surface 10 and consequently, a uniform nonwoven web having an excellent disintegration condition and a large collection width $W_2$ can be obtained stably and reliably on the collecting surface 10 without causing the mutual entanglement of the filaments.

A wide nonwoven fabric can be produced on an industrial scale by use of the apparatus of the present invention in the following manner.

In the apparatus shown in FIG. 1, a unit assembled by combining one each of the nozzle 5, the first impinging plate 8 and the second impinging plate 9 is hereby referred to as "one spinning set". A nonwoven fabric having a large width can be easily obtained by aligning a large number of the spinning sets on the direction of width of the collecting surface 10. A plurality of lines, each consisting of a large number of the spinning sets thus aligned, may also be aligned.

Figure 7A:
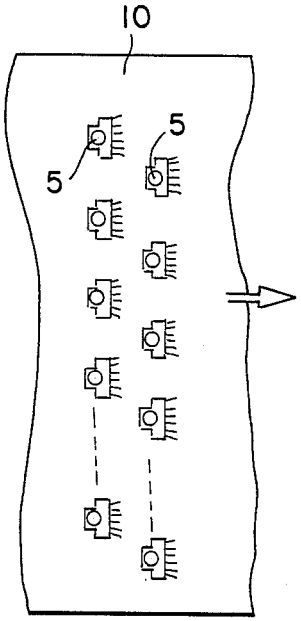
FIGS. 7*a*, 7*b* and 7*c* are plan views showing alternative apparatus useful in practicing the invention.
Figure 7B:
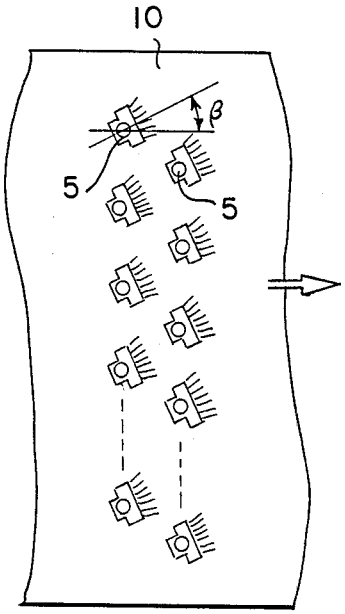
Figure 7C:
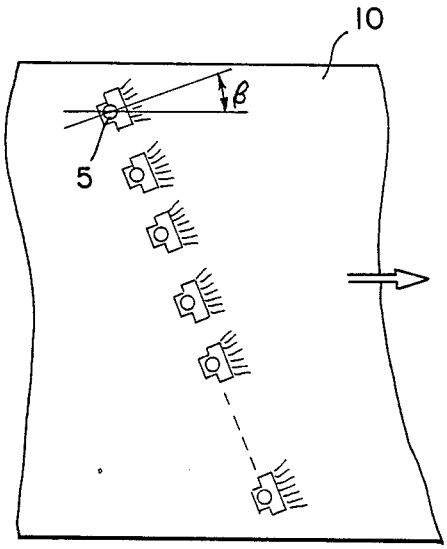

It is also possible to eliminate non-uniformity of weight per unit area between the spinning sets by disposing a plurality of the spinning sets in the zigzag arrangement as shown in FIG. 7*a*. The orientation of the filaments of the resulting nonwoven fabric can be controlled by defining an angle between the advancing direction of the collecting surface 10 and the jetting direction of the filaments. This is effective for controlling the longitudinal and transverse strength of the resulting nonwoven web or the further treated nonwoven web. FIG. 7*b* shows an embodiment in which the spinning sets are disposed in the zigzag arrangement while FIG. 7*c* shows an embodiment in which a plurality of spinning sets are linearly disposed so that the direction of each spinning set defines an angle with respect to the advancing direction of the conveyor. Dispositions of the spinning sets are not limited to these embodiments and the same concept also applies to other variations similar thereto.

Figure 8:
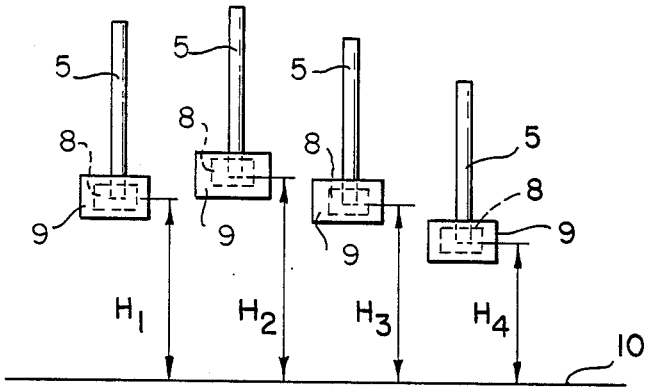
FIG. 8 is a front view showing an example of the distance from the collecting surface to the nozzle when a large number of nozzles are disposed in practicing the invention.

FIG. 8 shows an embodiment in which the distance H between the collecting surface 10 and the impinging surface 8′is different between the spinning sets in order to prevent the mutual interference of the fluid and filament bundle that are jetted from the adjacent spinning sets when a plurality of spinning sets are disposed.

Figure 9:
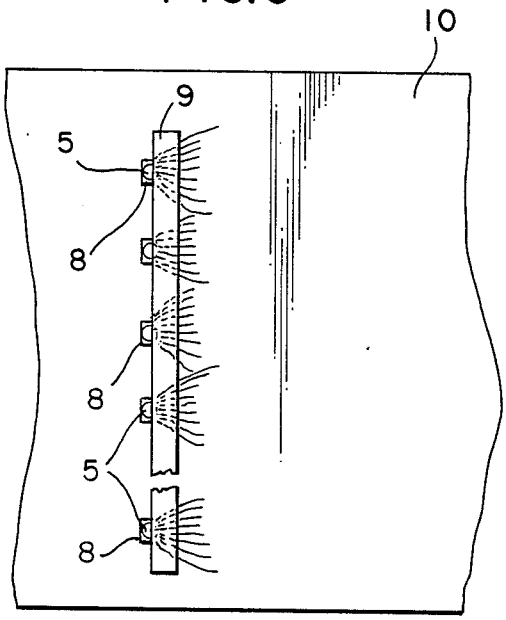
FIG. 9 is a model view in which a common single plate is shown disposed as the second impinging plate when a plurality of nozzles are disposed in practicing the invention.

When the spinning sets are arranged close to one another, the filaments 2 jetted from the first impinging plate 8 of a given spinning set would strike the second impinging plate 9 of the adjacent spinning set. In such a case, it is preferred that the second impinging plate 9 be a common single plate, as shown in FIG. 9.

In a method of obtaining a wide web on the collecting surface 10, it is possible to construct the impinging plate 8 of the spinning set so as to be capable of swinging independently. In such a case, it is possible to construct so that first and second impinging plates 8 and 9 are capable of swinging as shown in FIG. 10 or that only the first impinging plate 8 is capable of swinging with the second impinging plate 9 being fixed.

In this case, both sides at the tip of the first impinging plate 8 facing the second impinging surface 9′ preferably have a curveture lest they come into contact with the second impinging plate during rotation. Furthermore, the curveture preferably has its center at the axis of swinging of the first impinging plate 8 and the tip of the first impinging plate 8 is preferably a circle having the above-mentioned cuveture.

Figure 10:
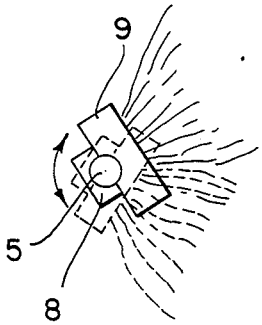
FIG. 10 is a schematic view showing the state where the first and second impinging plates are permitted to swing in practicing the invention.
Figure 11:
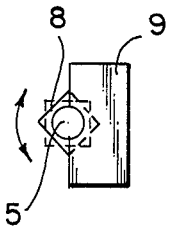
FIG. 11 is a schematic view when only the first impinging plate is permitted to swing in practicing the invention.
Figure 12:
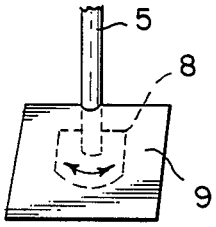
FIG. 12 is a schematic view showing the shape of the tip of the first impinging plate in practicing of the invention.

FIGS. 10, 11 and 12, the axis of swinging of the first impinging surface 8′ is in conformity with the axis of the nozzle and the arrow in these drawings represents the swinging direction of the first and second impinging plates (FIG. 10) or that of the first impinging plate (FIGS. 11 and 12).

Figures 13A, 13B, 13C:
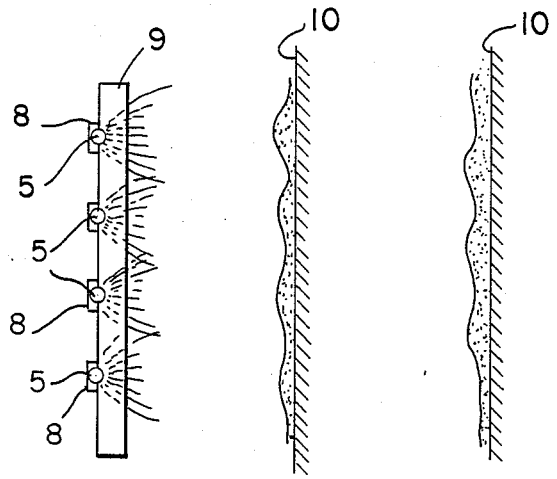
FIGS. 13*a*, 13*b* and 13*c* show the states of forming of the nonwoven webs in the transverse section on the collecting surface when a plurality of nozzles are aligned on a line.
Figure 14:
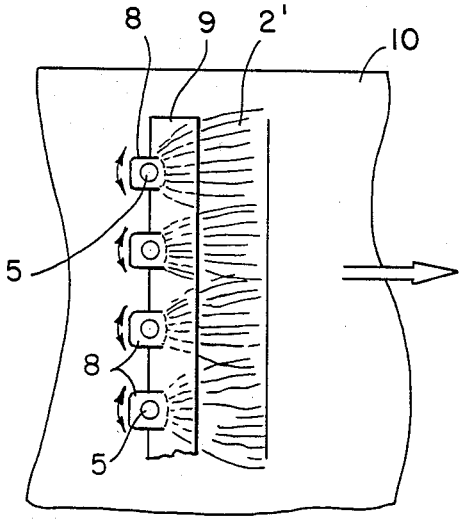
FIG. 14 is a schematic view showing the state of the dropping filaments on the collecting surface and useful for explaining the effect of the second impinging plate used in practicing of the invention.

When a plurality of impinging units are juxtaposed in the multiple spinning set arrangement, the distribution of the filaments is corrugated on the transverse section of the nonwoven web on the collecting surface 10 as shown in FIGS. 13*a* and 13*c*. If the pitch between the spinning set is large the center of the nonwoven web jetting direction becomes convex (FIG. 13*b*) and if it is small, overlap of the filaments due to interference between the spinning sets becomes great and the portions between the spinning sets become convex (FIG. 13*c*), forming ridges. In practice, however, the unevenness is not so much exreme as depicted in FIGS. 13*b* and 13*c*, which represents the uneven profile with exaggeration. The above-mentioned ridges can be eliminated by reciprocatingly rotating the first impinging plate 8 with the same phase and uniform fiber web can be laminated and collected in the direction of width of the collecting surface 10. If the second impinging plate 9 is shaped as a common single plate for the adjacent spinning sets, the points of drop of the disintegrated filaments are aligned on the same line on the collecting surface 10 including the adjacent spinning sets, and the cross wrapper on the moving collecting surface 10 becomes uniform by reciprocally rotating the first impinging plate 8 (FIG. 14).

Figure 15:
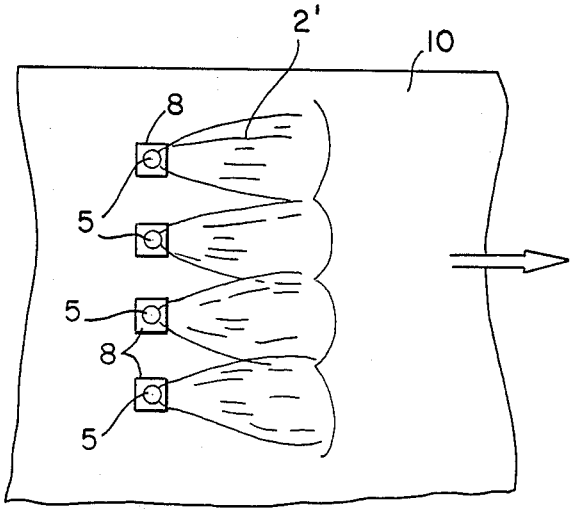
FIG.15 PRIOR ART
FIG. 15 is a schematic view showing the dropping state of the filaments on the collecting surface when the second impinging plate does not exist.

On the contrary, in the method devoid of the second impinging plate 9 such as in FIG. 15, disintegration of the filaments for each spinning set is inferior and the filaments drop on the collecting surface 10 in an arcuate profile. If a plurality of spinning sets are juxtaposed, therefore, the points of drop of the filaments describe a shape formed by connecting the above-mentioned arcuate profiles. Since this profile is reciprocatingly rotated with the same phase in the direction indicated by the arrow, uniform cross wrapper on the moving collecting surface becomes difficult.

The inventor of the present invention repeated a great deal of trials and errors to develop a jet nozzle for producing a nonwoven web which nozzle was capable of more sufficiently disintegrating, dispersing and expanding the filaments in practicing the present invention and during this work the inventors paid a specific attention to the fact that the water jet nozzle used for a sprinkler forms a thin uniform water film in the fan-like shape. The inventors then attempted to use a filament bundle and a fluid (generally, compressed air) for conveying the filament bundle to be used for practicing the present invention, in place of the water and, as a result, found unexpectedly that it was extremely effective for producing a nonwoven web having such a uniform thickness that could never be obtained by use of the conventional methods and devices. The present device is attained on the basis of this finding.

As described above, the present device is directed to provide a jet nozzle having a simple construction, which eliminate the problems with the prior art and which provides a uniform nonwoven web. The construction of the present device is as follows.

In a jet nozzle for practicing the present invention, the present device is characterized in that the jet nozzle consists of a cylinder portion and a tongue portion connected to a part of the lower end of the cylinder portion; a communication hole on the cylinder portion for permitting the passage of the filament bundle and the filament conveying fluid therethrough; the upper end of the communication hole serves as an inlet for the continuous filament bundle and for the filament conveying fluid with the lower end being kept open; the rear surface portion of the communication hole exposed to the open atmosphere is shielded by the upper part of the tongue portion connected to the cylinder portion; the lower surface portion is shielded by the lower part of the tongue portion; and the front surface portion and the side surface portion are kept open to the surrounding atmosphere.

Hereinafter, the present device will be explained in further detail with reference to an embodiment thereof shown in the drawings.

Figure 17:
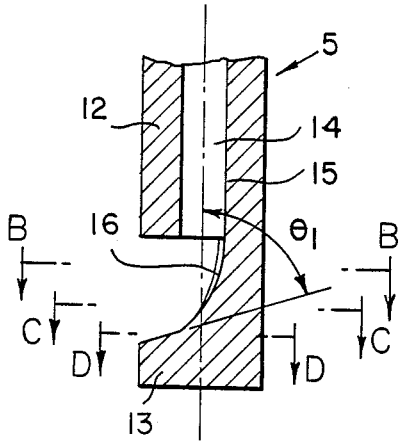
FIG. 17 is a sectional view taken along line A—A of FIG. 16.
Figure 16:
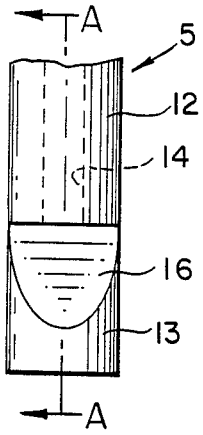
FIG. 16 is a front view showing the principal portions of the nozzle useful in practicing the invention.

FIG. 16 is a front view showing the principal portions of a jet nozzle 5 for producing a nonwoven web (hereinafter called simply a "nozzle") in accordance with an embodiment of the present device. FIG. 17 is a sectional view taken along line A—A of FIG. 16 and FIG. 18*a*, 18*b* and 18*c* are sectional views taken along lines B—B, C—C and D—D of FIG. 17, respectively.

In this embodiment, the nozzle 5 consist of a cylinder portion 12 and a tongue portion 13 (which corresponds to the first plate 8) connected to the lower end of the cylinder portion 12, and a communication hole 14 is bored in the cylinder portion 12 so that a continuous filament bundle or bundles and a filament conveying fluid (generally, compressed air is employed) can be passed therethrough. The upper end of the communication hole 14 of the cylinder 12 is connected to feed sources (not shown) for the continuous filaments and for the filament conveying fluid. In the lower part of the nozzle 5 shown in FIG. 17, the lower side, the left side and the right side represent the lower surface portion, the front surface portion and the rear surface portion of the nozzle, respectively, and the lateral portions between the front and rear surface portions represent the lateral surface portions. In this case, the rear surface portion of the nozzle 5 is shielded by the upper part of the tongue portion 13 interconnected to the cylinder portion 12, the lower end portion of the nozzle 5 defines a gap in cooperation with the lower end of the cylinder portion 12 and is shielded by the lower portion of the tongue portion 13, and the front surface portion of the nozzle 5 and the lateral surface portions of the nozzle 5 are open to the atmosphere around them.

Figure 18A:
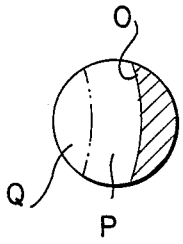
FIGS. 18*a*, 18*b* and 18*c* are sectional views taken along lines B—B, C—C and D—D of FIG. 17, respectively.
Figure 18B:
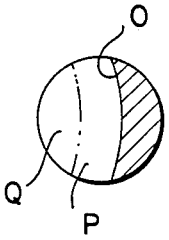
Figure 18C:
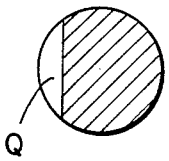

Accordingly, on the front surface of the tongue portion 13 is defined a smooth tongue surface 16 which is formed at the upper part of the tongue portion 13 continuing smoothly the inner wall 15 of the rear surface of the communication hole 14 disposed inside the cylinder portion 12. At the portion where the tongue surface 16 comes into contact with the inner wall 15 of the communication hole 14, the tongue surface 16 defines a part of a cylinder plane whose tangential plane is parallel to the center line of the nozzle 5 (or to the center line of the communication hole 14) but it becomes a part of the curvature of a rotary ellipsoid as it departs away from the lower end of the communication hole 14 until it smoothly shifts to the plane. In FIGS. 18*a*, 18*b* and 18*c*, the portion represented by o forms a part of the cylinder plane, the portion P forms a part of the curvature of the rotary ellipsoid and the portion represented by reference numeral 12 forms a part of the plane, and all these portions are connected to one another by smooth curvatures.

In the above-mentioned nozzle 5 of the present device, the continuous filament bundle is jetted at a high speed from the communication hole 14 while entrained by the filament conveying fluid. Both continuous filament bundle and filament conveying fluid pass through the whole sectional plane of the communication hole 14 but the direction of movement is gradually changed and, while they are being gradually spread, they take a film form and are discharged from the tip of the tongue surface 16. In this process, the filament conveying fluid that conveys the continuous filament bundle conveys extremely smoothly the filament bundle while its line of flow is not at all disturbed. Hence, a separation and an expansion of filaments can be formed without causing entanglement of the filaments.

The reason is not yet clarified why the nozzle of the present device provides more excellent effects in the disintegration, dispersion and expansion of the continuous filament bundle as compared with the prior art devices such as disclosed in the aformentioned Japanese Patent Publication No. 4026/1974, Japanese Patent Laid-Open No. 1183/1977 and the like. It is assumed, however, that in these prior art devices the line of flow of the filament conveying fluid is somehow disturbed presumably because the filament conveying fluid is accompanied by another fluid, and the continuous filaments and the filament conveying fluid are caused to impinge against the impinging plate that is disposed far from the end portion of the nozzle.

Figure 19:
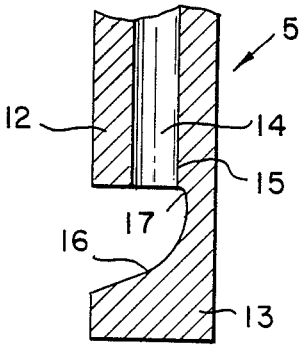
FIGS. 19 and 20 are sectional views, each showing a nozzle structure different from that in FIG. 17.
Figure 20:
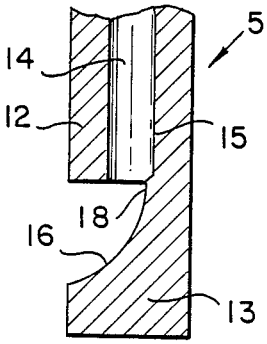

FIGS. 19 and 20 are sectional views, each showing the nozzle in accordance with another embodiment of the present device.

FIG. 19 shows a nozzle 5 which is equipped with a recess 17 at the connecting portion between the cylinder portion 12 and the tongue portion 13, while FIG. 20 shows a nozzle 5 which is equipped with a protuberance 18 at the connecting portion.

It is preferred that in the nozzle 5 of the present device, the cylinder portion 12 smoothly continues the tongue portion 13 as depicted in FIG. 16. Due to machining or for other reasons, the variations shown in FIGS. 19 and 20 or the occurrence of a discontinuous portion on the tongue surface 16 may be observed from time to time. Accordingly, the method of determining whether or not such a nozzle 5 is useable will be explained.

First, if the appearance inspection confirms that the inner wall 15 and the tongue surface 16 are smoothly connected to each other and the curvature of the tongue surface 16 is also joined smoothly, the nozzle 5 is useable without any problem. If recesses or protuberances exist, disturbance would occur in the filament conveying fluid that is jetter at a high speed. The extent of the recesses or protuberances may be conveniently inspected by use of water.

When the service water is fed to the upper end of the communication hole 14 of the nozzle 5 via a hose, the water is discharged while forming the water film having the fanlike shape even after it leaves the tongue surface 16. If the fanlike water film is not satisfactory, the nozzle 5 should be rejected as defective. According to the results of inspection carried out by the present inventors, those nozzles can be used in which the depth (t) of the recess or the height (t') of the protuberance is up to 10% of the radius (T) of the communication hole 14.

In the embodiments shown in FIGS. 16 through 18, the shape of the side wall is formed by smoothly connecting parts of the cylindrical plane, rotary ellipsoidal plane and flat plane, but it need not be complicated like that. In other words, in the sectional view of FIG. 17, the shape of the tongue surface may be a mere flat plane or a part of the cylindrical inner surface. Even when a part of the curvature is used it is preferred that the tip Q of the tongue surface 16 shown in FIGS. 18*a* through 18*c* is a flat plane.

Next, the tongue surface 16 has such expansion as to shield the rear surface portion of the nozzle 5 and to prevent an excessive gas stream from entering from the back. The overall expansion of the tongue surface 16 should be such that it can fully cover the communication hole 14 opposing the tongue surface 16 of is greater than that. For, the filament conveying fluid jetted from the communication hole 14 is likely to expand considerably when discharged into the atmosphere. Hence, disturbance would occur in the continuous filaments that are being conveyed, unless the tongue surface 16 has such expansion as to smoothly change the direction of, and to expand, all the filament conveying fluid that is being jetted from the communication hole 14.

Generally, the nozzle is produced as a unitary structure (but the cylinder portion 12 and the tongue portion 13 may naturally be detachable with respect to each other). Preferably, a columnar member having a diameter at least twice that of the communication hole is machined in order to fully satisfy the above-mentioned requirement.

The distance between the lower end and the tip of the tongue surface 16 is preferably equal to the diameter of the communication hole 14 or is several times greater than that. For, if the distance is small, machining becomes difficult, while if it is too large the speed of the continuous filament bundle and that of the filament conveying fluid that are discharged from the tip of the tongue surface 16 while being expanded would drop.

In the nozzle of the present device, the angle of inclination $\theta_1$ of the tip of the tongue surface 16 with respect to the center line of the nozzle 5 (or to the center line of the communication hole 14) must fall within a specific range. For, if it is too small, expansion of the filament bundle and filament conveying fluid is not sufficient and if it exceeds 90 degrees, expansion becomes excessive. It has been confirmed experimentally that a preferred range is from about 70 to about 80 degrees, more preferably from about 75 to about 80 degrees. However, a suitable range can be selected depending upon an intended application of the nozzle.

In the afore-mentioned embodiments, the sectional shape of the communication hole 14 is shown circular but it may by square, oval or polygonal.

As described above, the jet nozzle in accordance with the present device is capable of sufficiently disintegrating and expanding the filaments and then discharging them without disturbing the flow of the continuous filament bundle and that of the filament conveying fluid. Accordingly, the nozzle of the present device provides the excellent action and effect that a uniform web devoid of non uniformity in both thickness and density can be obtained.

Synthetic organic fibers are preferably used as the continuous filaments for obtaining a nonwoven web on the apparatus for preparing a nonwoven web according to the present invention. The continuous filaments of synthetic organic fibers are normally prepared at high speed in a bundle of 20, 50 or even about 200 individual filaments all spinning simultaneously from a multiholed spinneret. A denier of each of the individual filaments is preferably in the range of about 0.1 to about 30, and the filaments is preferably prepared from poly(ethylene terephtalate).

What is claimed is:

1. A nozzle to jet continuous filaments together with a filament conveying fluid for preparing a nonwoven web which comprises:

(a) a cylinder portion; and (b) a tongue portion which forms an impinging surface, the rear part of the tongue portion connected to a part of the lower end of the cylinder portion, a clearance angle ($\theta_1$) between the axis of the cylinder portion and the front surface of the tongue portion being in the range of from about 70 degrees to about 80 degrees, the tongue portion being substantially symmetric on the plane including the axis of the cylinder portion and the tip of the tongue portion;

a communication hole in the cylinder portion for permitting the passage of the continuous filaments and the communication hole serving as an inlet for the continuous filament and for the filament conveying fluid with the lower end of the communication hole being open and being exposed to the surrounding atmosphere, the upper part of the tongue portion being connected to the rear part of the lower end of the cylinder portion to shield the rear portion of the lower end of the communication hole; the lower end surface of the cylinder portion being shielded by the lower part of the tongue portion which extends beneath said end surface in spaced relation thereto; the front and side areas of the tongue being open so that the front and side parts of the lower end of the cylinder portion are unshielded and open to the surrounding atmosphere, whereby the filaments and conveying fluid exit the tongue portion in a fan-like flow to disperse the filaments in a uniform manner.

2. The apparatus of claim 1 wherein the tongue surface has a tangential plane parallel to the axis of the cylinder portion on and in the proximity of the communication hole, the tangential plane progressively inclining with respect to the axis of the cylinder portion as it gradually leaves the communication hole.

3. The apparatus of claim 2 wherein the tongue surface has symmetric planes including the axis of the nozzle.

4. The apparatus of claim 3 wherein the tip of the tongue portion is a substantially flat plane.

* * * * *

UNITED STATES PATENT AND TRADEMARK OFFICE

CERTIFICATE OF CORRECTION

PATENT NO. : 4,833,758

DATED : May 30, 1989

INVENTOR(S) : Sano et al

It is certified that error appears in the above-identified patent and that said Letters Patent is hereby corrected as shown below:

Column 10, line 65, after "and", insert --the filament conveying fluid therethrough, the upper end of--.

Column 10, line 66, delete "filament" and insert --filaments--.

Signed and Sealed this

Thirtieth Day of January, 1990

*Attest:*

JEFFREY M. SAMUELS

*Attesting Officer* *Acting Commissioner of Patents and Trademarks*